US007537056B2

(12) United States Patent
MacDougall

(10) Patent No.: US 7,537,056 B2
(45) Date of Patent: May 26, 2009

(54) SYSTEM AND METHOD FOR GAS SHUT OFF IN A SUBTERRANEAN WELL

(75) Inventor: Thomas D MacDougall, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 170 days.

(21) Appl. No.: 11/306,225

(22) Filed: Dec. 20, 2005

(65) Prior Publication Data

US 2006/0249291 A1 Nov. 9, 2006

Related U.S. Application Data

(60) Provisional application No. 60/593,207, filed on Dec. 21, 2004.

(51) Int. Cl.
*E21B 34/06* (2006.01)

(52) U.S. Cl. ..... 166/321; 166/319; 166/53; 166/373

(58) Field of Classification Search ..... 166/373, 166/53, 50, 319, 321
See application file for complete search history.

(56) References Cited

U.S. PATENT DOCUMENTS

| | | | | |
|---|---|---|---|---|
| 3,791,444 | A | 2/1974 | Hickey | |
| 4,490,095 | A | 12/1984 | Soderberg | |
| 4,665,991 | A * | 5/1987 | Manke | 166/373 |
| RE34,111 | E | 10/1992 | Wynn | |
| 5,417,284 | A * | 5/1995 | Jones | 166/280.1 |
| 5,732,776 | A | 3/1998 | Tubel | |
| 6,474,421 | B1 * | 11/2002 | Stoesz | 173/91 |
| 6,595,287 | B2 | 7/2003 | Fisher | |
| 6,705,404 | B2 | 3/2004 | Bosley | |
| 2002/0053426 | A1 * | 5/2002 | Kelley et al. | 166/67 |

FOREIGN PATENT DOCUMENTS

| | | |
|---|---|---|
| GB | 1331248 | 9/1973 |
| WO | 2006003112 A1 | 1/2006 |
| WO | 2006003113 A1 | 1/2006 |

OTHER PUBLICATIONS

Al-Anazi, H.A. and Sharma, M.M., "Evaluation of a pH-Sensitive Polymer for Gravel-Packing Operations," SPE 67292, Mar. 2001, pp. 1-10, SPE International, Oklahoma City, Oklahoma, U.S.

Al-Anazi, Hamoud A. and Sharma, Mukul M., "Evaluation of a pH-Sensitive Polymer for Gravel-Packing Operations," SPE 76813 (a revision of SPE 67292), Jan. 2002, pp. 28-36, Mar. 2002 SPE Drilling & Completion, SPE International, Oklahoma City, Oklahoma, U. S.

Al-Anazi, Hamoud A. and Sharma, Mukul M., "Use of a pH Sensitive Polymer for Conformance Control," SPE 73782, Feb. 2002, pp. 1-8, SPE International, Lafayette, Louisiana, U.S.

* cited by examiner

*Primary Examiner*—David J Bagnell
*Assistant Examiner*—Sean D Andrish
(74) *Attorney, Agent, or Firm*—Van Someren, PC; James L. Kurka; Daryl R. Wright

(57) ABSTRACT

A gas inflow control system is used in a well. A downhole tool is combined with an automatic valve that is automatically actuatable to a flow position in the presence of a well liquid flowing into the downhole tool. In the presence of gas flow into the valve, the valve automatically transitions toward or to a closed position.

19 Claims, 2 Drawing Sheets

SYSTEM AND METHOD FOR GAS SHUT OFF IN A SUBTERRANEAN WELL

CROSS-REFERENCE TO RELATED APPLICATIONS

The following is based upon and claims priority to U.S. Provisional Application Ser. No. 60/593,207 filed Dec. 21, 2004.

BACKGROUND

The invention generally relates to a system and method for producing well fluids from a wellbore. Many production wells are used to produce a desired liquid, such as a hydrocarbon based liquid, from subterranean formations. However, gas inflow into the hydrocarbon liquid being produced can lead to detrimental results. For example, the level of gas saturation can increase over time to a point where the gas cut is too high to economically produce the liquid hydrocarbon. The problem can exist in one or more producing reservoirs within the same well.

Attempts have been made to control the gas saturation of produced liquid. Those attempts, however, have relied on relatively complex, high cost devices that are either controlled from the surface or moved downhole via intervention techniques.

SUMMARY

The present invention comprises a system and method that automatically controls the influx of gas. A valve is combined with a downhole tool into which a well liquid flows. The valve remains in an open position during flow of well liquid through the valve, but the valve automatically moves toward a closed position upon exposure to a gas flow into the valve.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for controlling gas saturation of a liquid produced from a well. One or more valves are combined with one or more downhole tools to control the influx of gas into the downhole tools during production of a desired liquid. Each valve may comprise a valve actuator system which is automatically actuated by allowing a lower viscosity fluid, namely gas, to migrate from a zone of higher pressure in the valve to a zone of lower pressure in the valve. Once the gas flows into the zone of lower pressure, the fluid forces acting on the valve are equalized, enabling a spring device to transition the valve toward closure to reduce or prevent further inflow of gas into the downhole tool at that location.

Figure 1:
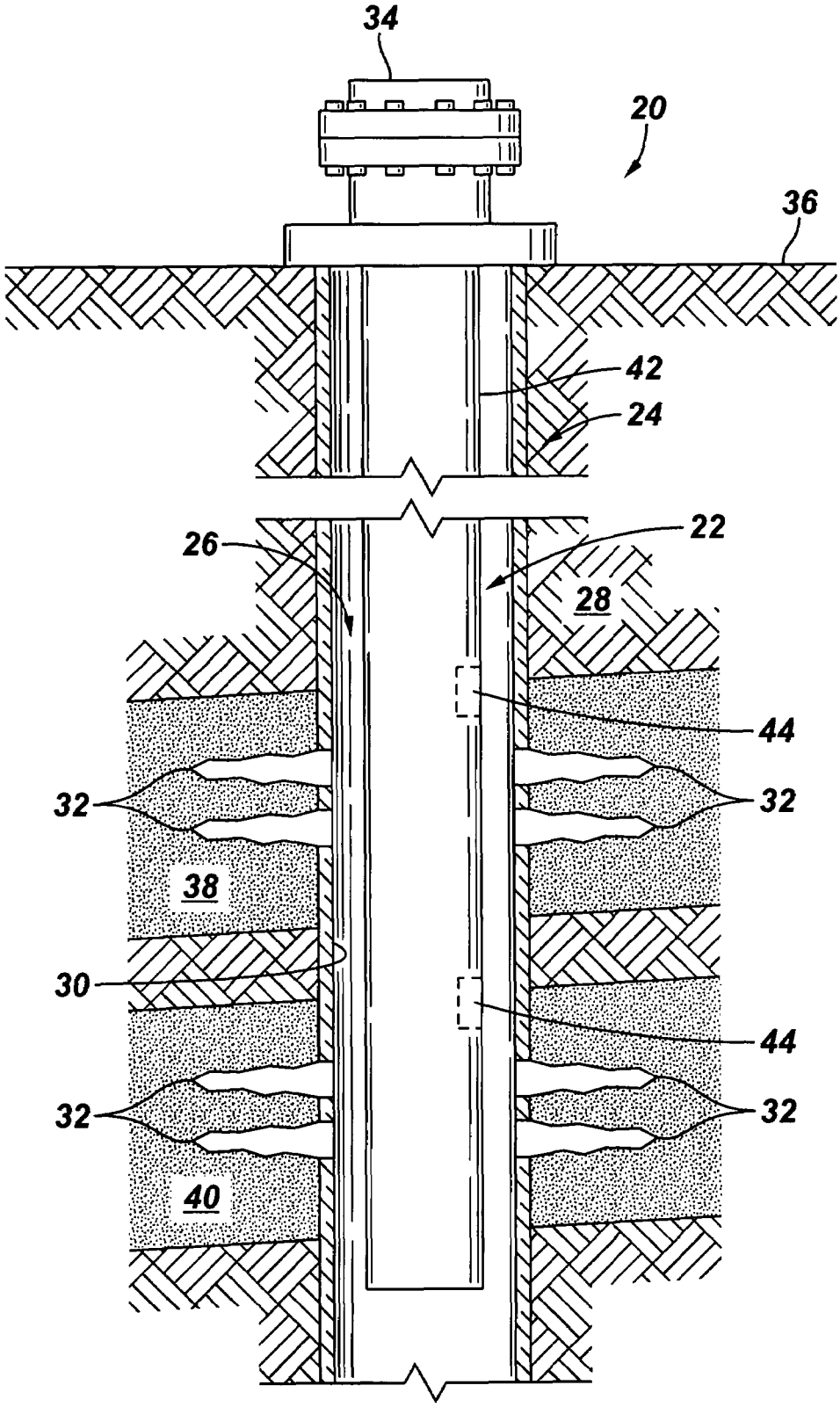
FIG. 1 is a front elevation view of a well system deployed in a wellbore, according to one embodiment of the present invention.

Referring generally to FIG. 1, a well system 20 is illustrated according to one embodiment of the present invention. The well system 20 comprises, for example, a downhole tool 22 deployed for use in a well 24 having a wellbore 26 drilled into a reservoir 28 containing desirable liquids, such as hydrocarbon based liquids. In many applications, wellbore 26 is lined with a wellbore casing 30 having perforations 32 through which liquids can flow into wellbore 26 from one or more surrounding formations within reservoir 28. Downhole tool 22 is deployed in wellbore 26 below a wellhead 34 which is disposed at a surface location 36, such as the surface of the Earth or a seabed floor. Wellbore 26 may be formed in regions that have one or more formations of interest, such as formations 38 and 40.

One or more of the downhole tools 22 is located within the interior of casing 30 and generally is suspended by a deployment system 42, such as a tubing. At least one valve 44 is combined with each downhole tool 22 and disposed in the flow path along which liquid flows from the surrounding formation into downhole tool 22. In the embodiment illustrated in FIG. 1, a plurality of valves 44, e.g. two valves, is used to admit liquid into downhole tool 22 while limiting or blocking the inflow of gas. Valves 44 may be combined with a variety of downhole tools 22, including sand screens, perforated tubulars or slotted liners.

Figure 2:
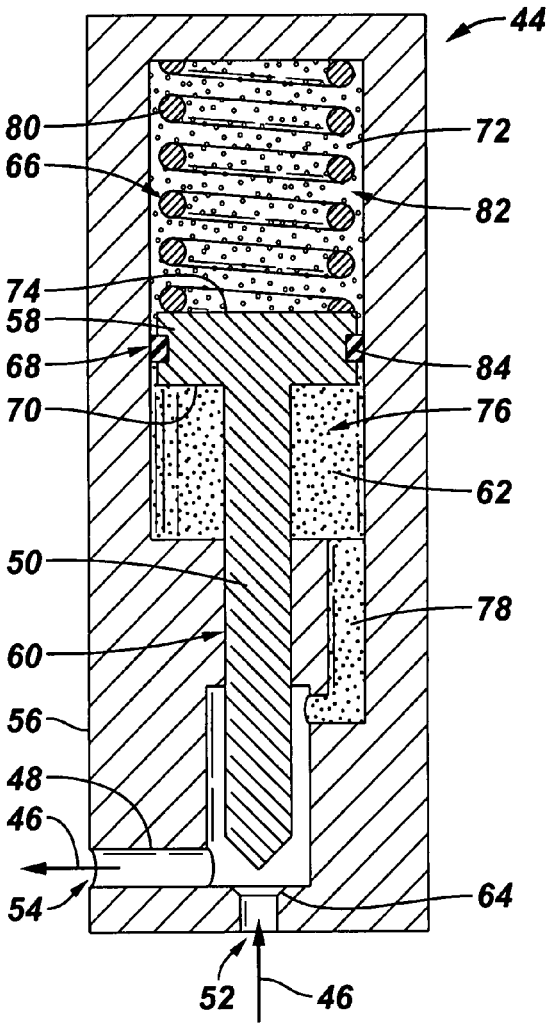
FIG. 2 is a cross-sectional view of an automatic gas control valve that can be used in the well system illustrated in FIG. 1, according to an embodiment of the present invention.

Generally, each valve 44 is designed to automatically control the flow or incursion of gas during production of a liquid from reservoir 28. However, in other applications, the valves 44 also can be used to control the flow of gas into the reservoir. One embodiment of valve 44 is illustrated in FIG. 2 as positioned in a flow path, represented by arrows 46, along which a well liquid flows into downhole tool 22. Valve 44 comprises a flow passage 48 that forms part of flow path 46. The flow passage 48 can be automatically opened for liquid flow through flow passage 48 and closed, or at least restricted, in the presence of gas flow into valve 44.

In the embodiment illustrated, valve 44 comprises an actuator 50 that is pressure responsive and interacts with flow passage 48 between a fluid inlet 52 and a fluid outlet 54. The actuator 50 is movable within a valve housing 56 to selectively allow communication between fluid inlet 52 and fluid outlet 54. When fluid flow is allowed and there is communication between fluid inlet 52 and fluid outlet 54, valve 44 is in an open position, as illustrated. However, when actuator 50 transitions valve 44 to a closed position, there is no communication between fluid inlet 52 and fluid outlet 54.

Although valve 44 may utilize different components, alternate configurations or different sizes, FIG. 2 illustrates one embodiment of a simple valve that can be used to automatically control any inflow of gas through the valve. In this embodiment, actuator 50 comprises a piston 58 and a valve closure member 60, such as a poppet, connected to piston 58. Piston 58 is slidably mounted in a cavity 62 disposed within housing 56 and can move valve closure member 60 into and out of contact with a valve seat 64. Additionally, the valve 44 comprises a spring device 66 and a gas transfer mechanism 68 used to equalize pressures across valve 44 when a gas is acting on actuator 50. The equalization of pressures across the valve, enables spring device 66 to move actuator 50 to a closed position and to thereby block flow along flow passage 48. It should be noted that actuator 50 may comprise other types of actuators, such as spool actuators or metering valve actuators.

In operation, a liquid, such as a hydrocarbon liquid, flows into fluid inlet 52 and acts against actuator 50 by providing pressure against a first face 70 of piston 58. In the presence of flowing liquid, the force resulting from pressure acting against first face 70 is higher than the opposing force due to pressure within a low pressure chamber 72. Any pressure within low pressure chamber 72 acts against an opposing or second face 74 of piston 58. Spring device 66 also acts against second face 74 of piston 58 to bias actuator 50 toward valve closure. However, the differential pressure created by liquid flow is able to overcome the spring bias and move actuator 50 to an open position, thereby enabling the flow of well liquid through flow passage 48.

As long as liquid is flowing along flow passage 48, valve 44 is maintained in an open state. In the specific embodiment illustrated, the liquid flows into a high pressure chamber 76 on the high pressure side of piston 58 via a passageway 78 extending between valve seat 64 and high pressure chamber 76. Gas transfer mechanism 68 prevents the liquid from passing into low pressure chamber 72. However, when gas flows into valve 44 through inlet 52, it is able to move through passageway 78, high pressure chamber 76 and gas transfer mechanism 68 until it enters low pressure chamber 72. This gas permeation through gas transfer mechanism 68 continues until the fluid pressure within high pressure chamber 76 is substantially equal to the fluid pressure within low pressure chamber 72. When this pressure equalization across the valve occurs, spring device 66 is no longer overpowered by the pressure differential acting on piston 58, and the spring device can move actuator 50 toward closure until valve closure member 60 engages valve seat 64 to close valve 44.

Spring device 66 may comprise a variety of mechanisms to bias actuator 50 toward a closed position. For example, spring device 66 may comprise a mechanical spring 80, such as a coil spring. Alternatively or in addition, spring device 66 may comprise a gas spring 82, such as a nitrogen spring. Regardless of the specific design, the spring device 66 is selected to provide an appropriate bias less than the counterforce acting against actuator 50 due to the pressure of well liquid flowing into fluid inlet 52 and through valve 44.

Gas transfer mechanism 68 also may comprise a variety of mechanisms or combinations of mechanisms that enable the flow of a gas therethrough while maintaining a liquid seal. For example, gas transfer mechanism 68 may comprise a variety of gas permeable materials, controlled mechanical orifices, such as those having small, highly restrictive passageways, and restrictive, choked flow passages. By way of example, gas transfer mechanism 68 may comprise a gas permeable material formed as a membrane or as an elastomeric seal 84 disposed around piston 58 between high pressure chamber 76 and low pressure chamber 72. Examples of gas permeable materials that can be used to form seals, membranes or other gas transfer mechanisms include Viton™, Butyl™, Nitrile™, Neoprene™, and Silicon™. Various materials have different gas permeability rates and can be selected based on the specific design parameters of a given valve system.

In one embodiment, valve 44 is designed such that it does not transition directly from the open state to the closed state. In this embodiment, the valve 44 gradually moves from the open state to the closed state as the valve is, for example, exposed to greater concentrations of gas. Thus, as more gas flows into valve 44 over time, the valve gradually transitions toward closure until the closed position is reached and further flow of fluid into downhole tool 22 is prevented. In this embodiment, valve 44 effectively has choked positions between the open state and the closed state.

Figure 3:
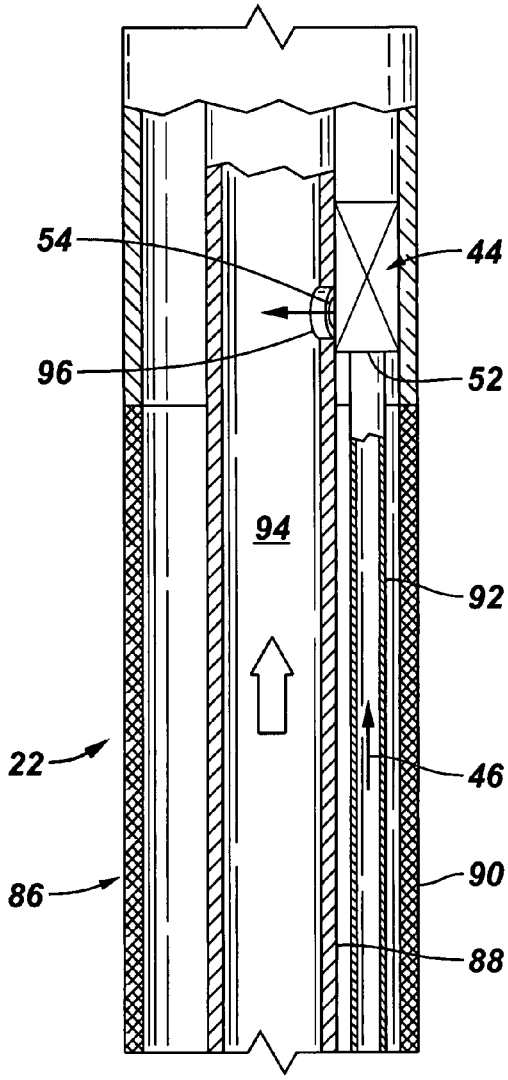
FIG. 3 is a cross-sectional view of a well tool combined with the automatic gas control valve, according to an embodiment of the present invention.

Referring generally to FIG. 3, valve 44 is illustrated as deployed in combination with one example of a downhole tool 22. In this embodiment, downhole tool 22 comprises a sand screen 86. The sand screen 86 comprises a base pipe 88, a screen 90, and a conduit 92, such as a shunt tube. The conduit 92 is positioned between the screen 90 and the base pipe 88 for directing the flow of fluid passing through screen 90 into valve 44. In this embodiment, the fluid inlet 52 of valve 44 is in communication with conduit 92, and the fluid outlet 54 of valve 44 is in communication with an interior 94 of base pipe 88 via at least one port 96 formed through base pipe 88. Accordingly, valve 44 automatically enables the flow of liquids from conduit 92 into the interior 94 of base pipe 88 for production to a desired location. However, valve 44 also automatically restricts the flow of gas from conduit 92 into the interior of base pipe 88.

In this manner, one or more valves 44 can be utilized in a variety of downhole tools 22. In some applications, for example, valves 44 can be incorporated into the lower completion of a producing oil well. Additionally, a plurality of the valves 44 can be located along the length of a single sand screen or multiple sand screens extending across a plurality of zones within a wellbore. Thus, in the event of gas breakthrough in a particular zone, the valve 44 proximate that zone transitions from an open state to a closed state, or from an open state to a choked position, to prevent or restrict gas cut into the oil produced from that zone. Each valve 44 is wholly autonomous and performs as a stand-alone system without the need for communication to or from the surface. Additionally, the valves 44 require no intervention to effectively operate in the prevention of gas inflow into the produced liquid.

Accordingly, valves 44 can be used in a variety of downhole systems and tools to automatically open, close or meter flow in the presence of a low viscosity fluid, e.g. gas. Once each valve is exposed to gas, the gas automatically moves from a high pressure region of the valve to a lower pressure region via a gas transfer mechanism, thus equalizing pressure across the valve. This enables a biasing member, e.g. spring device 66, to move a valve actuator toward a position of valve closure.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a wellbore to control gas inflow into a downhole tool configured to be positioned proximate to a formation comprising a desired liquid and a gas, the system comprising:

the downhole tool comprising a flow path from the formation to an interior of the downhole tool; and a valve positioned in the flow path, the valve having a pressure responsive actuator that automatically maintains the valve in an open position when exposed to liquid flow and automatically closes the valve upon exposure to gas flow into the valve, the pressure responsive actuator comprising a piston hydraulically communicating with the flow path and configured to translate within a cavity, the piston being biased by a spring towards a closed position; and wherein the bias of the spring is overcome by pressure from the liquid flow acting against a side of the piston opposite the spring, the valve further comprising a gas transfer mechanism, the gas transfer mechanism configured to facilitate gas passing to a side of the piston acted on by the spring but preventing liquid flow to the side of the piston acted on by the spring.

2. The system as recited in claim 1, wherein the gas transfer mechanism comprises a gas permeable seal.

3. The system as recited in claim 1, wherein the spring comprises a mechanical spring.

4. The system as recited in claim 1, wherein the spring comprises a nitrogen spring.

5. The system as recited in claim 1, wherein the downhole tool comprises a sand screen.

6. The system as recited in claim 1, wherein the downhole tool comprises a perforated tubular.

7. The system as recited in claim 1, wherein the downhole tool comprises a slotted liner.

8. A system for use in a wellbore to stop gas inflow, comprising:

a downhole tool into which a liquid flows from a surrounding formation; and a valve positioned in a flow path along which the liquid flows into the downhole tool, the valve having an actuator moved by a pressure of the liquid flow to an open position but biased in an opposite direction toward a position blocking flow of the liquid along the flow path, the valve further comprising a gas transfer mechanism that allows a gas in the valve to equalize pressure across the actuator such that the actuator is biased to the position blocking the liquid flow.

9. The system as recited in claim 8, wherein the actuator comprises a piston.

10. The system as recited in claim 8, wherein the actuator is biased in the opposite direction by a spring.

11. The system as recited in claim 8, wherein the gas transfer mechanism comprises a gas permeable material.

12. A method, comprising:

locating a valve in a downhole tool:

opening the valve by pressure of a well liquid thereby facilitating the flowing of the well liquid into the downhole tool through the valve;

providing the valve with a gas transfer mechanism configured to automatically transition the valve toward closure upon flow of a gas into the valve by facilitating a transfer of the gas acting on a first face of an actuator to a second face of the actuator so as to equalize gas pressure acting on the first face and the second face; and biasing the actuator toward closure of the valve.

13. The method as recited in claim 12, wherein locating comprises locating the valve within a downhole sand screen.

14. The method as recited in claim 12, wherein the pressure of the well liquid is applied against the actuator to open the valve.

15. The method as recited in claim 12, wherein enabling comprises forming the gas transfer mechanism as a gas permeable seal disposed about the actuator.

16. A system comprising:

a valve for controlling fluid flow within a wellbore, the valve comprising:

an actuator movable between a flow closed position and a flow open position;

a spring device positioned to bias the actuator toward the flow closed position; and a gas permeable seal positioned about the actuator to enable gas migration in a manner that reduces a differential pressure on the actuator such that the spring device is able to move the actuator to the closed position.

17. The system as recited in claim 16, wherein the spring comprises a mechanical spring.

18. The system as recited in claim 16, wherein the actuator comprises a piston having a first face exposed to the fluid and configured such that pressure of the fluid acts on the first face to move the actuator toward the flow open position.

19. The system as recited in claim 18, wherein the piston comprises a second face on an opposite side from the first face, the second face being exposed to the bias of the spring device in a direction towards the flow closed position.

* * * * *